US005353467A

United States Patent [19]

Junger

[11] Patent Number: 5,353,467

[45] Date of Patent: Oct. 11, 1994

[54] SUSPENDED CLEANING DEVICE FOR TEXTILES MACHINES

[76] Inventor: Reiner Junger, Griesbachstrasse 20, D-8904 Friedberg, Fed. Rep. of Germany

[21] Appl. No.: 26,583

[22] Filed: Mar. 5, 1993

[30] Foreign Application Priority Data

Jun. 12, 1992 [DE] Fed. Rep. of Germany ... 9207902[U]

[51] Int. Cl.[5] ..... B08B 5/00

[52] U.S. Cl. ..... 15/312.2; 15/345

[58] Field of Search ..... 15/312.1, 312.2, 316.1, 15/345; 57/304, 305, 306

[56] References Cited

U.S. PATENT DOCUMENTS 3,018,503 1/1962 Hijiya et al. ..... 15/312.1
3,304,570 2/1967 Seress et al. ..... 15/321.1
4,121,318 10/1978 Jacobi ..... 15/312.2

FOREIGN PATENT DOCUMENTS 421711 12/1934 United Kingdom ..... 15/312.1
1077718 8/1967 United Kingdom ..... 15/312.1

*Primary Examiner*—Timothy F. Simone
*Assistant Examiner*—Charles Cooley

[57] ABSTRACT

A cleaning device for a row of textile machines has a duct extending along the textile machines, with a longitudinal slot which is covered by sealing lips on both sides and in which a boat-shaped nozzle of the cleaning device travelling on rollers engages. To avoid the need for rails for the cleaning device, the rollers are supported on the duct and the cleaning device is guided by the duct. The cleaning device is thus suspended from the duct. The duct is suspended via carriers from the ceiling. Flanged rollers that roll on the top of the duct are connected via vertical stays to the cleaning device which travels below the duct. The duct has the slot on its underside which is sealed by the sealing lips. The boat-shaped nozzle extends upwardly and engages the slot while spreading the sealing lips apart, the nozzle leading to a distributor box to which blast hoses are attached.

4 Claims, 3 Drawing Sheets

SUSPENDED CLEANING DEVICE FOR TEXTILES MACHINES

FIELD OF THE INVENTION

The invention relates to a travelling cleaning device for a row of textile machines.

BACKGROUND TO THE INVENTION

In a known travelling cleaning device for textile machines, a track retained by base supports is provided. Rollers of the cleaning device running above the track travel on the track. A suction duct is located beside the track or between the individual rails of the track. The suction duct has a longitudinal slot at the top which is covered on each of both sides by a sealing lip. The cleaning device has a boat-shaped nozzle extending downwardly which engages in the slot of the suction duct while spreading the sealing lips apart. The boat-shaped nozzle communicates with suction hoses of the cleaning device, so that flying fibres in the region of the textile machines being travelled over are drawn off via the hoses, the nozzle and the suction duct.

On the side of the track opposite the suction duct, there is a contact rail into which an electric current collector of the cleaning device engages, so that the drive motor for the actuated rollers can be supplied with power.

This cleaning device structure is expensive and requires, in addition, a relatively large amount of space for the reason that the suction duct, track and contact rail are arranged adjacent to one another.

SUMMARY OF THE INVENTION

An object of the present invention is to provide a cleaning device which is less expensive to construct and requires less space.

In accordance with an embodiment of the invention, a cleaning device for textile machines has a duct running along and above the textile machines, the duct being fastened to a ceiling and having a longitudinal slot located on an underside of the duct, the slot being covered by sealing lips and engaged by a nozzle of a cleaning carriage travelling on rollers, the rollers being supported on a top side of the duct and the cleaning carriage being suspended from the rollers and travelling below the duct.

BRIEF INTRODUCTION TO THE DRAWINGS

Embodiments of the invention shall be described in greater detail below with reference to the following drawings, in which.

DETAILED DESCRIPTION OF THE INVENTION

Figure 1:
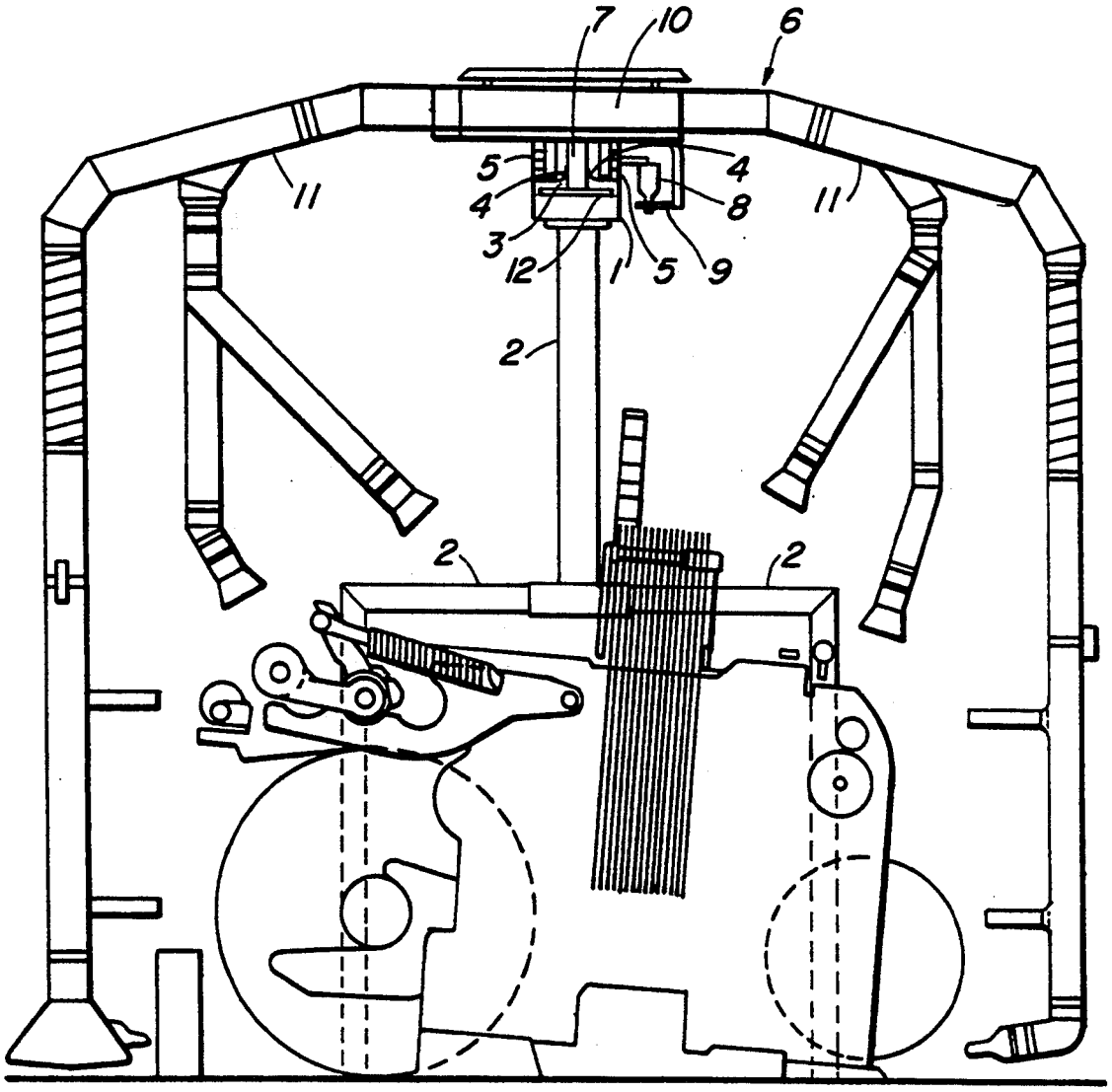
FIG. 1 is a front view of a first embodiment.
Figure 2:
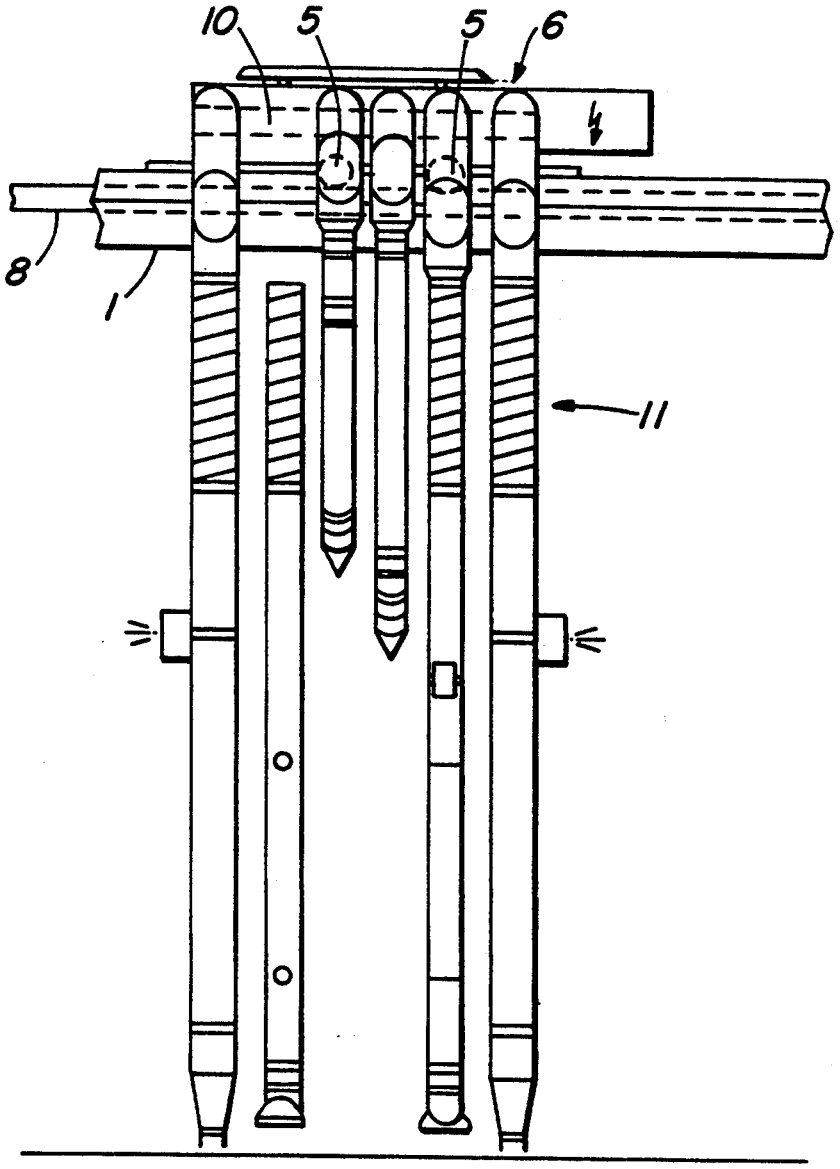
FIG. 2 is a side view of the first embodiment.

As shown in FIGS. 1 and 2, a suction duct 1 is carried by spaced portal standpipes 2. Suction duct 1 has a longitudinal slot 3 on its upper side. A resilient sealing lip 4 is provided on each side of the slot 3, which sealing lips 4 usually adjoin one another and seal the slot 3.

The rollers 5 of a cleaning device 6 run on the top of the suction duct 1 on both sides of the sealing lips 4. The rollers 5 are flanged rollers, the flanges of which are led through the side walls of the duct 1. Preferably, two spaced roller pairs are provided. The cleaning device 6 has a boat-shaped nozzle 7 which projects downward, spreads the sealing lips 4 apart and engages into the suction duct 1.

A contact rail 8, in which a current collector 9 of the cleaning device 6 engages, extends alongside the suction duct 1. A drive motor, which actuates roller pair 5 via a gear mechanism, is connected to the current collector 9.

The boat-shaped nozzle 7 leads to a distributor box 10 of the cleaning device 6 to which various suction hoses 11 are attached.

A safety rod 12, which is longer than the width of the slot, is connected to suction nozzle 7. This safety rod 12 can be locked diagonally to the axis of the duct and can be tilted in the direction of the duct axis to assemble or disassemble the cleaning device.

Figure 3A:
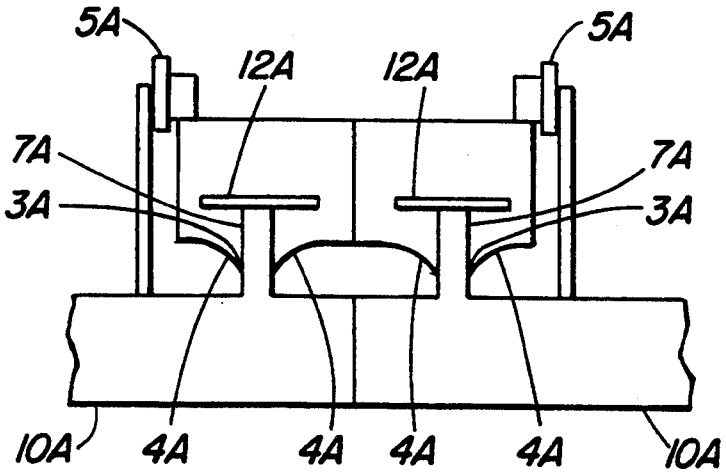
FIG. 3A illustrates a double duct structure.
Figure 3:
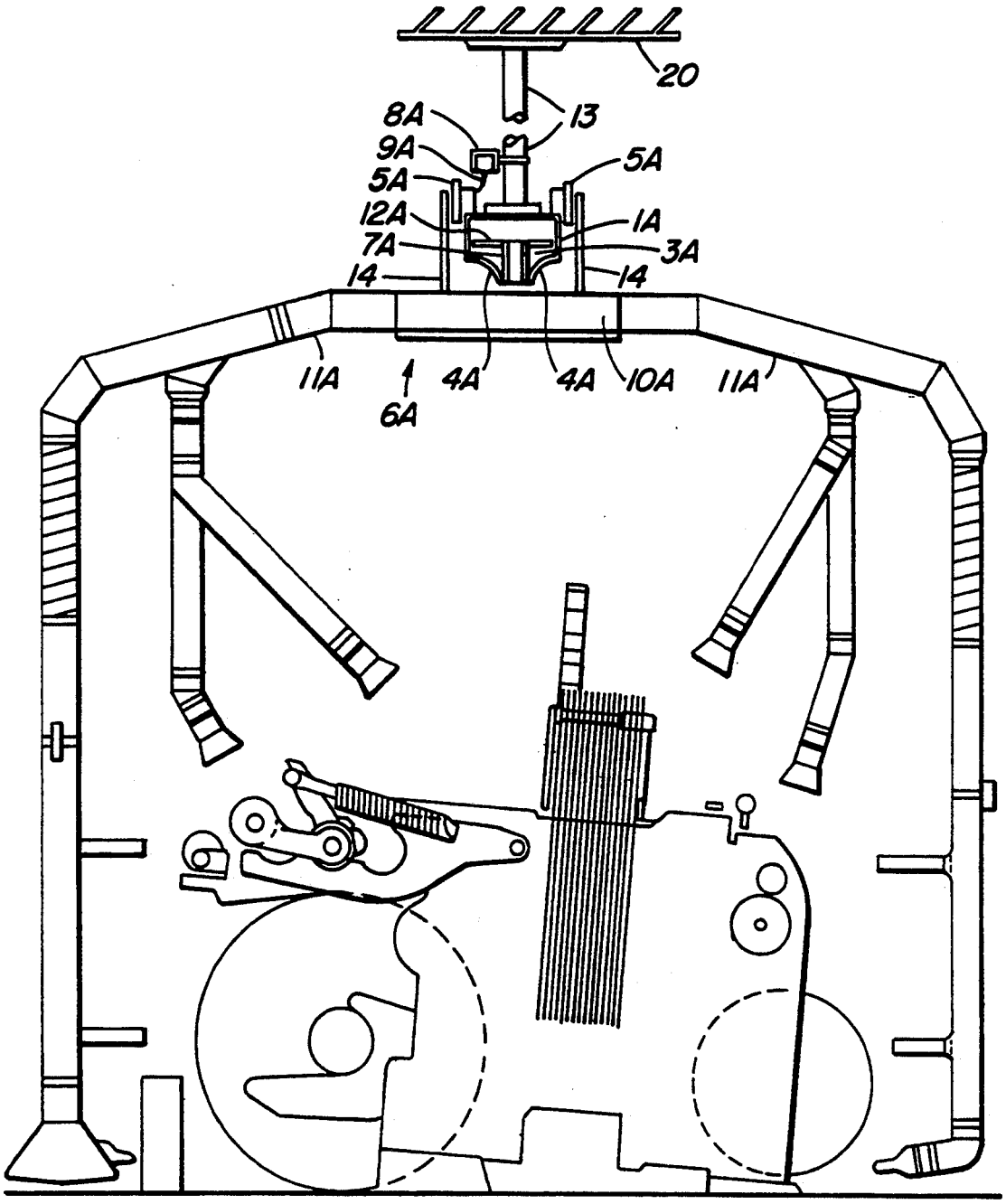
FIG. 3 is a front view of another embodiment.

While the cleaning device in FIGS. 1 and 2 is supported on the suction duct 1 by its rollers 5, FIG. 3 illustrates and embodiment in which the cleaning device is suspended on the duct 1. The duct 1A of FIG. 3 is suspended via carriers 13 from the ceiling 20. The flanged rollers 5A move on the top of duct 1A and are connected via vertical stays 14 to the cleaning device 6A which travels below the duct 1A. Duct 1A has slot 3A on its underside which is usually sealed by the sealing lips 4A. The boat-shaped nozzle 7A, extending upward, engages in this slot 3A while spreading the sealing lips 4A apart. This nozzle leads to distributor box 10A to which blast hoses 11A are attached.

Contact rail 8A into which the current collector 9A engages extends above the duct 1A. Current collector 9A supplies the above-noted drive motor with power which drives the roller pair via a gear mechanism. In addition, the above-noted safety rod 12A is provided.

Thus in the illustrated embodiments, duct 1 or 1A is used as a track, so that a separate track can be omitted. The safety rod 12 or 12A prevents the cleaning device 6 or 6A from disengaging which could, for example, occur should one of the hoses 11 or 11A run against an obstacle.

Duct 1 or 1A is attached in a known manner to the suction side of a stationary blower. A filter, in which the flying fibres are separated, is provided between the blower and duct 1 or 1A.

The cleaning device 6 or 6A travels from one end of the row of textile machines to the other end, then back again to the first end, etc., and is equipped with its own drive.

Cleaning device 6 or 6A can also be driven indirectly. For example, a chain, which is guided over a sprocket wheel at each of the two ends of the textile machine row, can be attached to both ends of the cleaning device 6 or 6A, whereby one of the sprocket wheels is driven by a motor. As a separate drive for the cleaning device 6 or 6A is not required in this case, the contact rail and the current collector as well as the drive motor with gear mechanism for actuating a pair of rollers can be omitted.

Duct 1 or 1A is a suction duct in the above embodiments. However, it could alternatively be a pressure duct which is attached to the pressure side of a stationary blower. In this case, hoses 11 and 11A blow the flying fibres away from the textile machines.

A combination blast/suction operation is also possible in which the duct is designed as a double duct as shown in FIG. 3A. In this case each duct half should have a slot 3A and sealing lips 4A, into each of which a nozzle 7A engages. These nozzles 7A should be connected to two separate distributor boxes to which blast and suction hoses are attached. One duct half is attached to the pressure side and the other duct half to the suction side of a blower.

I claim:

1. A cleaning device for textile machines having a duct running along and above the textile machines, the duct being fastened to a ceiling and having a longitudinal slot located on an underside of the duct, the slot being covered by sealing lips and engaged by a nozzle of a cleaning carriage travelling on rollers, the rollers being supported on a top side of the duct and the cleaning carriage being suspended from the rollers and travelling below the duct.

2. A cleaning device as defined in claim 1, in which the rollers are flanged rollers whose flanges surround side walls of the duct.

3. A cleaning device as defined in claim 1, in which the duct is a double duct comprised of duct halves, each duct half having a slot covered by sealing lips, a nozzle of the cleaning carriage engaging in each duct half, one duct half being a suction duct and the other duct half being a pressure duct.

4. A cleaning device as defined in claim 1, further comprising a safety rod extending orthogonally to the nozzle and situated on the nozzle, the safety rod being longer than the width of the slot and being capable of being located on the nozzle orthogonally to a duct axis.

* * * * *